US005173080A

United States Patent [19]

Longtin

[11] Patent Number: 5,173,080

[45] Date of Patent: Dec. 22, 1992

[54] MULTIPLE PART IDENTIFICATION CARD PRODUCTION

[75] Inventor: Andre Longtin, Weare, N.H.

[73] Assignee: Moore Business Forms, Inc., Grand Island, N.Y.

[21] Appl. No.: 921,211

[22] Filed: Jul. 29, 1992

[51] Int. Cl.[5] ..... B42D 15/00

[52] U.S. Cl. ..... 462/2; 283/101; 283/109; 40/626

[58] Field of Search ..... 462/2, 3, 900; 285/81, 285/101, 109, 900, 904; 40/625, 626–630

[56] References Cited

U.S. PATENT DOCUMENTS

| | | | |
|---|---|---|---|
| 3,505,140 | 4/1970 | Dunn | 156/249 |
| 3,697,101 | 10/1972 | Loos et al. | 462/2 |
| 3,804,226 | 4/1974 | Ellis | 462/2 |
| 3,854,229 | 12/1974 | Morgan | 40/2 |
| 4,112,603 | 9/1978 | Guilie | 40/2 |
| 4,159,586 | 7/1979 | Blum | 40/2 R |
| 4,407,524 | 10/1983 | Trautlein | 282/9 R |
| 4,648,189 | 3/1987 | Michel | 283/900 |
| 4,692,394 | 9/1987 | Drexler | 283/900 |
| 4,695,077 | 9/1987 | Pretre | 283/81 |
| 4,986,868 | 1/1991 | Schmidt | 156/249 |
| 5,127,879 | 7/1992 | Schubert | 462/2 |

*Primary Examiner*—Timothy V. Eley
*Assistant Examiner*—Willmon Fridie, Jr.
*Attorney, Agent, or Firm*—Nixon & Vanderhye

[57] ABSTRACT

An identification card intermediate is constructed so that it has a multi-part construction overlying the base stock of the intermediate. The basic web, comprising a transparent plastic substrate with a base stock covering the first side and a release liner covering the second side, is mated with one or more paper webs and carbon sheet webs so that paper and carbon sheets overlie the base stock of the basic web. A glue pattern adjacent one edge of the base stock holds the paper and carbon sheets in place, and a perforation line through the webs allows detachment of the overlying paper and carbon sheets from the base stock.

20 Claims, 3 Drawing Sheets

MULTIPLE PART IDENTIFICATION CARD PRODUCTION

BACKGROUND AND SUMMARY OF THE INVENTION

Identification cards, such as made by Moore Paragon in France since 1987, and such as shown in U.S. Pat. No. 4,695,077, desirably are constructed in a manner such that a transparent plastic substrate is connected by permanent adhesive to a base stock (bond paper) and a release liner, the base stock and release liner each covering approximately one half of the plastic substrate. The base stock has printing formed on it. By removing the release liner, the end user of the identification card—once the appropriate identification, signature, photo, or the like is provided on the base stock—moves the portion of the transparent plastic substrate previously covered by the release liner over the face of the base stock, thereby covering and protecting it, while still allowing the relevant information on the base stock to be viewed.

There are some times when it is desirable to provide one or more record copies of the identification card for official or other use. In the past, there has been no easy mechanism for effecting that. However, according to the present invention, an identification card intermediate is provided which allows this to be accomplished in a simple and effective manner by providing a multi-part construction overlying the base stock, with one or more record copies readily detachable from the base stock for official or other use.

According to one aspect of the present invention an identification card intermediate is provided which comprises the following elements: A transparent plastic substrate having first and second edges parallel to each other, and third and fourth edges perpendicular to the parallel edges, and having first and second faces. A base stock having first, third, and fourth edges in substantial alignment with the substrate first, third, and fourth edges, respectively, and a second edge; and having first and second faces. Indicia printed on the first face of the base stock. A release liner having second, third, and fourth edges in substantial alignment with the substrate second, third, and fourth edges, respectively, and having first and second faces. An adhesive layer substantially covering the first face of the substrate, and connecting the second face of each of the base stock and the release liner to the substrate. The length of the third and fourth edges of each of the release liner and the base stock being roughly one half the length of the substrate third and fourth edges. And at least one paper layer having first through fourth edges in substantial alignment with the base stock first through fourth layers and removably attached thereto, and transfer means between the at least one paper layer and the base stock for transferring indicia applied to the paper layer to the base stock first face.

Typically, the paper layer and transfer means—which usually comprises a carbon sheet—are attached by glue to the base stock and each other along the first edge of the base stock, and a perforation line (or other line of weakness) is provided adjacent the glue pattern. The perforation line allows detachment of the substrate, base stock and overlying sheets connected by the glue pattern to each other, from the rest of the intermediate. The length of the base stock along the third and fourth edges thereof from the perforation to the release liner is equal to the length of the release liner along the third and fourth edges thereof. Typically, the same preprinted indicia is provided on the one or more overlying paper layers as on the base stock; and, of course, any indicia applied to the paper layers is transferred by the carbon sheets to the base stock, and to any other intermediate paper layers.

According to another aspect of the present invention, a method of making an identification card intermediate is provided. The method comprises the following steps: (a) Constructing a basic web comprising a transparent plastic substrate with permanent adhesive covering a first face thereof, with a second face thereof free of adhesive, and having a base stock covering a first side thereof connected to the adhesive, and a release liner covering a second side thereof connected to the adhesive, with a longitudinal part line between the base stock and release liner, and indicia printed on the top face of the base stock. (b) Feeding at least one bond sheet web and at least one transfer sheet web into contact with the basic web with a transfer sheet web covering the base stock portion only of the basic web. (c) Connecting the at least one bond sheet web and at least one transfer sheet web to each other and to the basic web so as to provide a multiple part form essentially commensurate in extent with the base stock to form a composite web. And (d) forming a longitudinal line of weakness in the composite web at the base stock adjacent a longitudinal edge thereof remote from the release liner, so that any sheets covering the base stock can be readily removed by detachment along the line of weakness.

Step (c) is typically practiced by applying glue between the webs adjacent the longitudinal edge thereof remote from the release liner, between that longitudinal edge and the longitudinal line of weakness, which line of weakness preferably is a perforation. Also, there may be the further step of automatically printing indicia on the at least one bond sheet web to effect transfer of the indicia onto the top face of the base stock, for example, while the composite web is being driven using tractor holes therein.

Steps (a)–(d) are typically practiced so that the dimension of the base stock perpendicular to the longitudinal line of weakness from the line of weakness to the portion thereof closest to the release liner, is essentially equal to the dimension of the release liner in the dimension perpendicular to the longitudinal line of weakness. Steps (b) and (c) are typically practiced to apply and secure two bond sheet webs and transfer webs over the basic web.

It is a primary object of the present invention to provide an enhanced identification card intermediate, one allowing the simple production of record copies, and the easy separation and retention thereof. This and other objects of the invention will become clear from an inspection of the detailed description of the invention and from the appended claims.

DETAILED DESCRIPTION OF THE DRAWINGS

Figure 1:
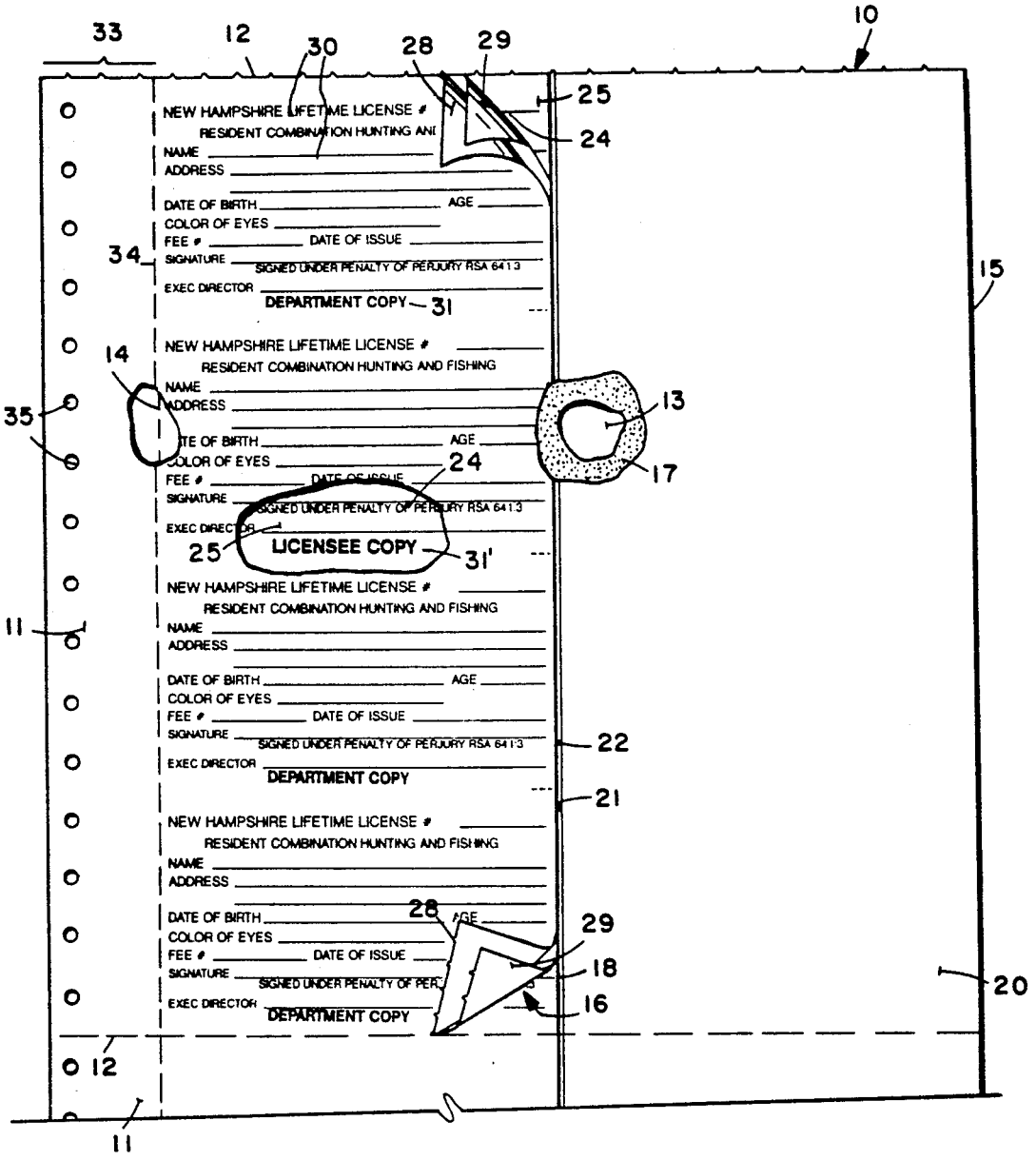
FIG. 1 is a top plan view of an exemplary identification card intermediate according to the present invention.

A plurality of identification card intermediates, disposed in continuous form, are illustrated generally by reference numeral 10 in FIG. 1. As is conventional, such as provided by Moore Paragon of France since 1987, and as shown in FIG. 1, each intermediate 11 is separated by a perforation line 12 from other intermediates 11. Each intermediate 11 includes a transparent plastic substrate 13 having a first edge 14 and an opposite, parallel second edge 15, and having third and fourth edges defined by the perforation lines 12. The edges 14, 15 are perpendicular to the edges defined by the perf lines 12. A base stock 16, such as of bond paper, is connected by permanent adhesive layer 17 to the substrate 13, and has first, third and fourth edges aligned with the edge 14, and perf lines 12 of the substrate 15, and a second edge 18 parallel to the edge 14 and at an intermediate portion of the substrate 13. Adjacent the base stock 16, and also connected by the adhesive 17 to the substrate 13, is a release liner 20, having second, third, and fourth edges aligned with the edge 15 and perf lines 12 of the substrate 13, and having a first edge 21 parallel to the edge 15, and parallel to the edge 18 of the base stock 16 and spaced only a short distance therefrom, a longitudinal gap 22 being defined between the edges 18, 21. The release liner 20 is of typical release material which will not permanently adhere to the adhesive 17, such as a waxed or silicone coated paper.

What has been described heretofore is conventional. What is new according to the invention is the provision of a multi-ply construction of a form overlying the base stock 16. According to the invention at least one paper layer 28 having first through fourth edges in substantial alignment with the base stock 16 and removably attached to the base stock 16 (along the left edge thereof) overlays the base stock 16. A transfer means, preferably a piece of carbon paper 29, is disposed between the paper layer 28 and the base stock 16 for transferring indicia applied to the paper layer 28 to the base stock first face 25. The paper layer 28 also preferably has indicia printed thereon, indicated by reference numeral 30 in FIG. 1, that corresponds to the indicia printed on the base stock 16 in large measure. However, there will be indicia 31 on the paper layer 28 that is different than the corresponding indicia 31' on the base stock 16. The layers 28, 29 are held to the base stock 16 by the removable left margin portion 33 as will be described in more detail with respect to other embodiments, with a common line of weakness or perf line 34 (defining the first edge 14 of the base stock 16), and with a plurality of tractor drive openings 35 therein.

Figure 2:
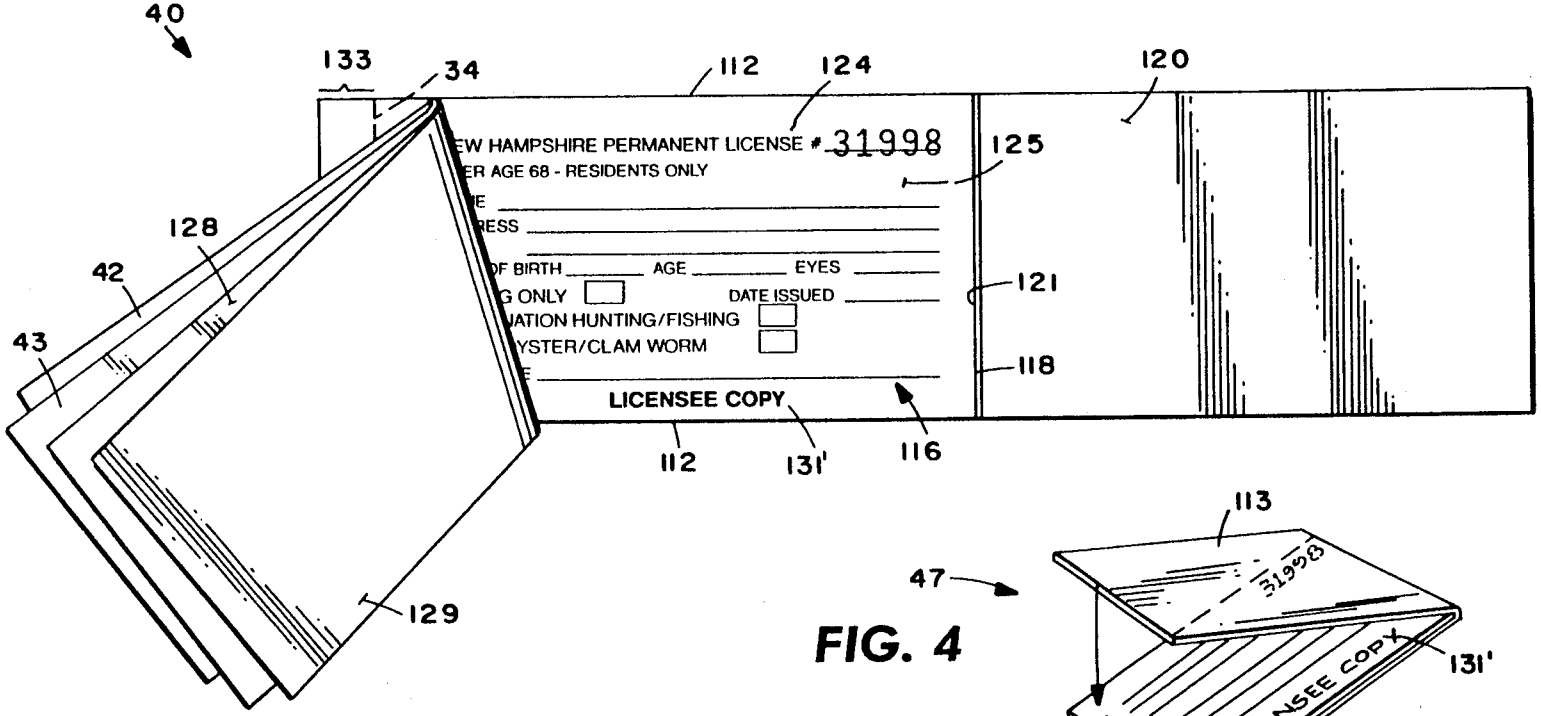
FIG. 2 is a top plan view, with some of the layers peeled away, of another exemplary construction of identification card intermediate according to the invention.
Figure 3:
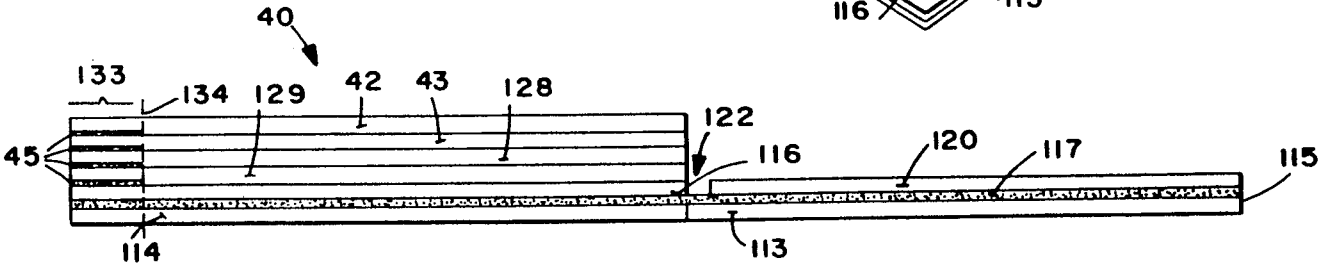
FIG. 3 is an exaggerated size side view of the identification card intermediate of FIG. 2 while the components thereof lay flat.

FIGS. 2 and 3 illustrate a very similar identification card intermediate according to the invention, shown generally by reference numeral 40. Structures in the FIGS. 2 and 3 embodiment comparable to those in the FIG. 1 embodiment are shown by the reference numeral only preceded by a "1".

FIG. 3 in particular shows the different layers of the intermediate 40, including the transparent plastic substrate 113, the permanent adhesive coat 117, the release liner 120, and the base stock 116. In the embodiment of FIGS. 2 and 3, the identification card intermediate 40 has two paper sheets 128, 42, with two transfer means in the form of carbon sheets 129, 43. FIG. 3 illustrates how the various sheets 128, 129, 42, 43 are held together into the base stock 116, adhesive layers 45 being provided between the various components in the removable margin portion 133 to the left of the common perforation line 134, as viewed in FIGS. 2 and 3. By detachment of the sheets 128, 129, 42, 43 along the perforation line 134, they may be removed from the base stock 116. Also, the entire margin portion 133 is removed from the substrate 113 and base stock 116 too.

Figure 4:
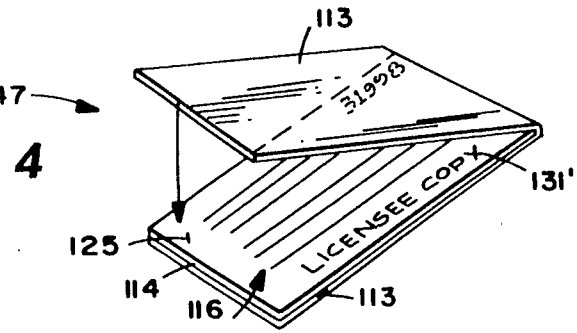
FIG. 4 is a perspective view showing the construction of a final identification card utilizing the intermediate of FIGS. 2 and 3.

To make an identification card 47—see FIG. 4—utilizing the intermediate 40 of FIGS. 2 and 3, after the appropriate indicia has been written or printed on with a typewriter or computer printer, on the blank spaces by the indicia 124, and the left margin portion 133 has been detached and the sheets 128, 129, 42, 43 removed (and the sheets 42, 128 kept as record copies), the person receiving the identification card (in this case a hunting license) removes the release liner 120, and then folds over the portion of the transparent plastic substrate 113 previously covered by the release liner 120, as illustrated by the arrow in FIG. 4, to protect the indicia 131', etc. that appears on the top face 125 of the base stock 116, the adhesive 117 on the lower part of the portion of the substrate 113 covering the top face 125 of the base stock 116 holding the transparent substrate portion 113 in place. Note that the length of each of the portions 116, 120 along the edges 112 from the perforation line 134 to the edge 115 is approximately equal, each taking up approximately half of the dimension of the substrate 113 in that direction, the substrate 113 only being slightly longer than the combined lengths of portions 116, 120 due to the presence of the small gap 122.

Figure 5:
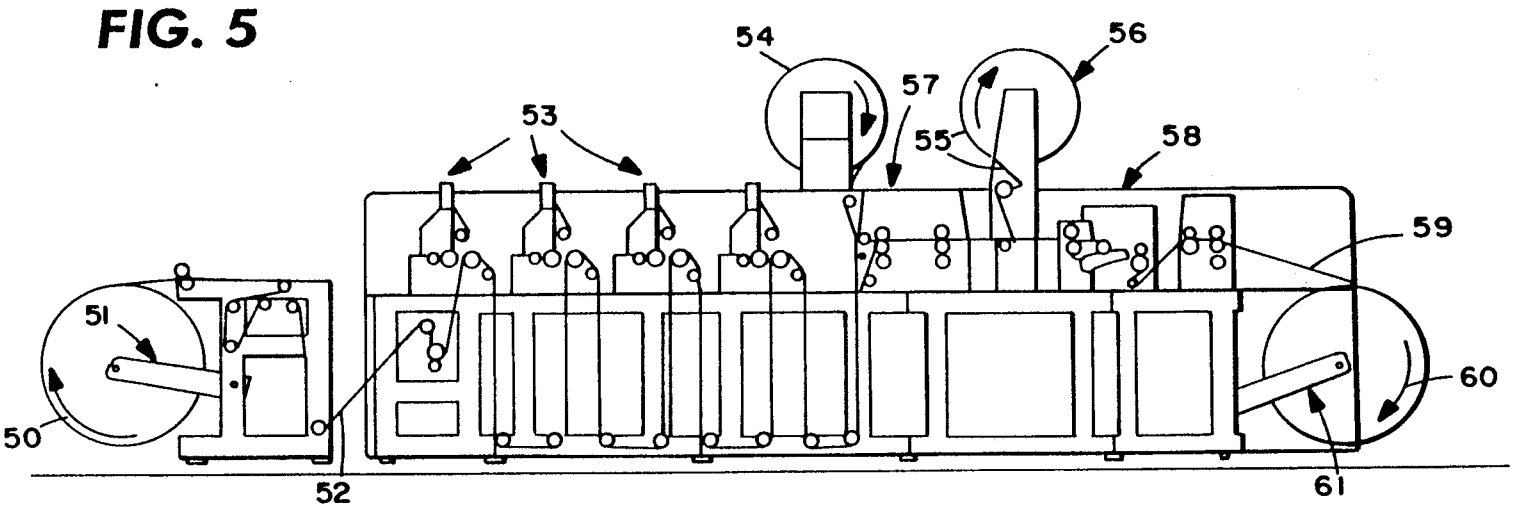
FIG. 5 is a side schematic view of exemplary apparatus for producing the basic web used in the construction of the identification card intermediate of FIGS. 1 and 2.

FIG. 5 schematically illustrates exemplary equipment that can be used to make the basic web formed by the continuous form of the transparent plastic substrate 13, 113 with permanent adhesive covering 17, 117, with a base stock 16, 116 covering a first side thereof connected to the adhesive, and a release liner 20, 120 covering the second side thereof connected to the adhesive, with a longitudinal part line 22, 122 between the base stock and the release liner, and indicia 24, 124 printed on the top face of the base stock 16, 116.

The base stock 16, 116 is in roll form as indicated at 50 in FIG. 5, and preferably is bond paper (typically card stock). The card stock, in web form 52, is unwound from unwind station 51 and passes through one or more print stations 53, which print the indicia 24, 124, and also often print the back side of the base stock 16, 116 too (which is visible through the bottom portion of the transparent substrate 113 as viewed in FIG. 4). The card stock web 52 is typically delivered to the printing stations 53 one-half inch wider than its desired finished size.

Two mil clear polyester, which will serve as the plastic substrate 13, 113 is in roll form as illustrated at 54 in FIG. 5, and has release liner 20, 120 applied to the entire face thereof. Half of the liner is removed, as illustrated by web 55 taken up on a waste take-up 56 of the laminating station, a vertical slit having been formed in the liner 54, corresponding to the part line 22, 122. Then the exposed adhesive 17, 117 on the liner 54 is laminated to the back side of the card stock 52. The identification form intermediate is then marginally punched (e.g., along both the left and right sides) at station 57, and then slit to the finished width at station 58, and then the basic web 59 is taken up into a roll 60 by the take-up mechanism 61.

Figure 6:
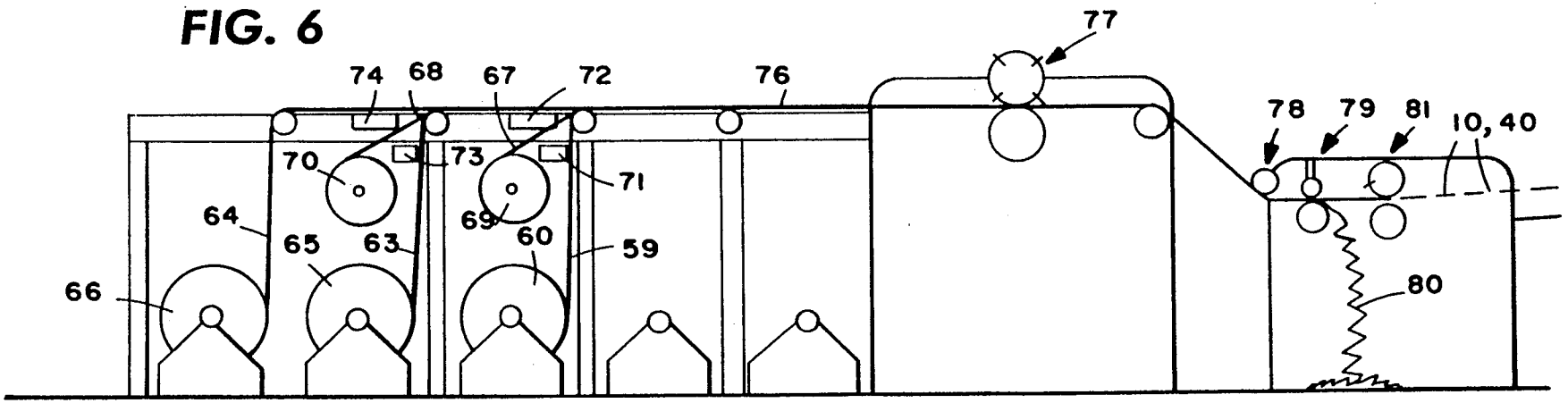
FIG. 6 is a side schematic view of exemplary apparatus for producing a final identification card intermediate of FIGS. 1 and 2, in a continuous mechanized operation.

FIG. 6 shows the formation of the intermediate 10, 40 according to the invention utilizing the basic web 59 in roll 60.

Bond sheet webs 63, 64 are unrolled from rolls 65, 66, while strip coated carbon webs 67, 68 are unwound from rolls 69, 70. Glue nozzles 71, 72, 73, and 74 apply glue patterns which hold the components together along what will ultimately be the detachable margin portion 33, 133 thereof. All the components are then assembled together into the composite web 76, and are acted upon by an auxiliary perf cylinder assembly 77 to interinal horizontal perfs as required (inserting perf lines 34, 134). The composite web 76 may then be fed to a SNPL sheeter unit 78, and the marginal punching may be slit off and excess trim collected at station 79, the excess trim being designated 80 in FIG. 6. Finally, if desired, the continuous composite web 76 may be cut at station 81 into individual identification card intermediates 40 (as illustrated in FIGS. 2 and 3), or into sheets having multiple individual identification cards 10 (as illustrated in FIG. 1).

Of course, prior to disposition of the webs 63, 64 in the apparatus of FIG. 6, they are preferably printed to have indicia thereon corresponding to the indicia 24, 124 on the base stock 16, 116, however, typically with some indicia (e.g., 31) being different.

It will thus be seen that according to the present invention an identification card intermediate that allows the easy production of record copies has been provided, as well as a method of making such an identification card intermediate. While the invention has been herein shown and described in what is presently conceived to be the most practical and preferred embodiments, it will be apparent to those of ordinary skill in the art that many modifications may be made thereof within the scope of the invention, which scope is to be accorded the broadest interpretation of the appended claims so as to encompass all of equivalent structures and processes.

What is claimed is:

1. An identification card intermediate comprising:

a transparent plastic substrate having first and second edges parallel to each other, and third and fourth edges perpendicular to said parallel edges, and having first and second faces;

a base stock having first, third, and fourth edges in substantial alignment with said substrate first, third, and fourth edges, respectively, and a second edge; and having first and second faces;

indicia printed on said first face of said base stock;

a release liner having second, third, and fourth edges in substantial alignment with said substrate second, third, and fourth edges, respectively, and having first and second faces;

an adhesive layer substantially covering said first face of said substrate, and connecting said second face of each of said base stock and said release liner to said substrate;

the length of said third and fourth edges of each of said release liner and said base stock being roughly one half the length of said substrate third and fourth edges; and at least one paper layer having first through fourth edges in substantial alignment with said base stock first through fourth layers and removably attached thereto, and transfer means between said at least one paper layer and said base stock for transferring indicia applied to said paper layer to said base stock first face.

2. An intermediate as recited in claim 1 wherein said paper layer is removably attached to said base stock by glue disposed adjacent to said first edge of said base stock, and further comprising a line of weakness on the opposite side of said glue pattern as said first edge.

3. An intermediate as recited in claim 2 wherein the length of said base stock from said line of weakness parallel to said first edge on the opposite side of said line of weakness from said glue pattern is essentially equal to the length of said release liner third and fourth edges.

4. An intermediate as recited in claim 3 wherein said transfer means comprises a carbon sheet.

5. An intermediate as recited in claim 4 wherein said at least one paper layer comprises two paper sheets, and wherein said transfer means comprises a carbon sheet between said paper sheets, and another carbon sheet between one of said paper sheets and said base stock.

6. An intermediate as recited in claim 5 in combination with a plurality of substantially identical other intermediates connected together in continuous form at said third and fourth edges thereof.

7. An intermediate as recited in claim 6 further comprising means defining tractor drive holes adjacent said first edge of said substrate and said base stock.

8. An intermediate as recited in claim 1 in combination with a plurality of substantially identical other intermediates connected together in continuous form at said third and fourth edges thereof.

9. An intermediate as recited in claim 8 further comprising means defining tractor drive holes adjacent said first edge of said substrate and said base stock.

10. An intermediate as recited in claim 1 wherein said transfer means comprises a carbon sheet.

11. An intermediate as recited in claim 1 wherein said at least one paper layer comprises two paper sheets, and wherein said transfer means comprises a carbon sheet between said paper sheets, and another carbon sheet between one of said paper sheets and said base stock.

12. An intermediate as recited in claim 3 wherein said line of weakness is a perforation line.

13. A method of making an identification card intermediate, comprising the steps of:

(a) constructing a basic web comprising a transparent plastic substrate with permanent adhesive covering a first face thereof, with a second face thereof free of adhesive, and having a base stock covering a first side thereof connected to the adhesive, and a release liner covering a second side thereof connected to the adhesive, with a longitudinal part line between the base stock and release liner, and indicia printed on the top face of the base stock;

(b) feeding at least one bond sheet web and at least one transfer sheet web into contact with the basic web with a transfer sheet web covering the base stock portion only of the basic web;

(c) connecting the at least one bond sheet web and at least one transfer sheet web to each other and to the basic web so as to provide a multiple part form essentially commensurate in extent with the base stock to form a composite web; and (d) forming a longitudinal line of weakness in the composite web at the base stock adjacent a longitudinal edge thereof remote from the release liner, so that any sheets covering the base stock can be readily removed by detachment along the line of weakness.

14. A method as recited in claim 13 wherein step (c) is practiced by applying glue between the webs adjacent the longitudinal edge thereof remote from the release liner, between that longitudinal edge and the longitudinal line of weakness.

15. A method as recited in claim 13 comprising the first step of automatically printing indicia on the at least one bond sheet web to effect transfer of the indicia onto the top face of the base stock.

16. A method as recited in claim 13 wherein steps (a)–(d) are practiced so that the dimension of the base stock perpendicular to the longitudinal line of weakness from the line of weakness to the portion thereof closest to the release liner, is essentially equal to the dimension of the release liner in the dimension perpendicular to the longitudinal line of weakness.

17. A method as recited in claim 13 wherein steps (b) and (c) are practiced to apply and secure two bond sheet webs and transfer webs over the basic web.

18. A method as recited in claim 13 wherein step (d) is practiced by forming a perforation line as the line of weakness.

19. A method as recited in claim 14 wherein steps (b) and (c) are practiced to apply and secure two bond sheet webs and transfer webs over the basic web.

20. A method as recited in claim 17 wherein steps (a)–(d) are practiced so that the dimension of the base stock perpendicular to the longitudinal line of weakness from the line of weakness to the portion thereof closest to the release liner, is essentially equal to the dimension of the release liner in the dimension perpendicular to the longitudinal line of weakness.

* * * * *